US005947037A

United States Patent [19]

Hornberger et al.

[11] Patent Number: 5,947,037

[45] Date of Patent: Sep. 7, 1999

[54] PORTABLE FOLDING TABLE INCORPORATING A LIGHTWEIGHT CORE

[75] Inventors: Timothy G. Hornberger, Green Bay; Dennis G. Griepentrog, De Pere, both of Wis.

[73] Assignee: Krueger International, Inc., Green Bay, Wis.

[21] Appl. No.: 09/008,732

[22] Filed: Jan. 19, 1998

[51] Int. Cl.[6] ..... A47B 3/00

[52] U.S. Cl. ..... 108/115; 108/27; 108/153.1

[58] Field of Search ..... 108/115, 180, 108/186, 153.1, 157.1, 157.14, 157.18, 158.11, 158.12, 159, 157.12, 27, 161

[56] References Cited

U.S. PATENT DOCUMENTS

| | | | |
|---|---|---|---|
| 1,668,909 | 5/1928 | Janes | 108/159 |
| 2,654,649 | 10/1953 | Pasewalk et al. | 108/159 |
| 3,533,363 | 10/1970 | Reiss | 108/153.1 |
| 4,951,576 | 8/1990 | Cobos et al. . | |
| 5,271,338 | 12/1993 | Bonham . | |
| 5,623,882 | 4/1997 | Price . | |
| 5,694,865 | 12/1997 | Raab . | |

*Primary Examiner*—Jose V. Chen
*Attorney, Agent, or Firm*—Andrus, Sceales, Starke & Sawall

[57] ABSTRACT

A lightweight, portable table includes a table top defined by upper and lower plastic shells which capture a core and an apron assembly therebetween. The core is constructed from a lightweight material such as honeycomb paperboard, expanded foam or the like. The apron assembly supports the core and includes a plurality of frame members interconnected by corners. The corners include connection elements which extend into the ends of corresponding frame members to interconnect the frame members. A folding leg assembly supports the table top above a supporting surface and is pivotable between a first, operative position and a second, inoperative position. Mounting assemblies are interconnected to the bottom surface of the core and to the frame members in order to pivotably interconnect the leg assembly to the table top.

19 Claims, 7 Drawing Sheets

18
172
90
5
22
174
4
16
6
172
5
6
170
17
80
176
4
20
12
14

22
370
90
16
366
18
380
383
364
412
368
394
392
80
406
391
390
20
400
404
370
402
408
398
410
362
360
14
358
354
352

354a
356
15
356a

FIG. 8
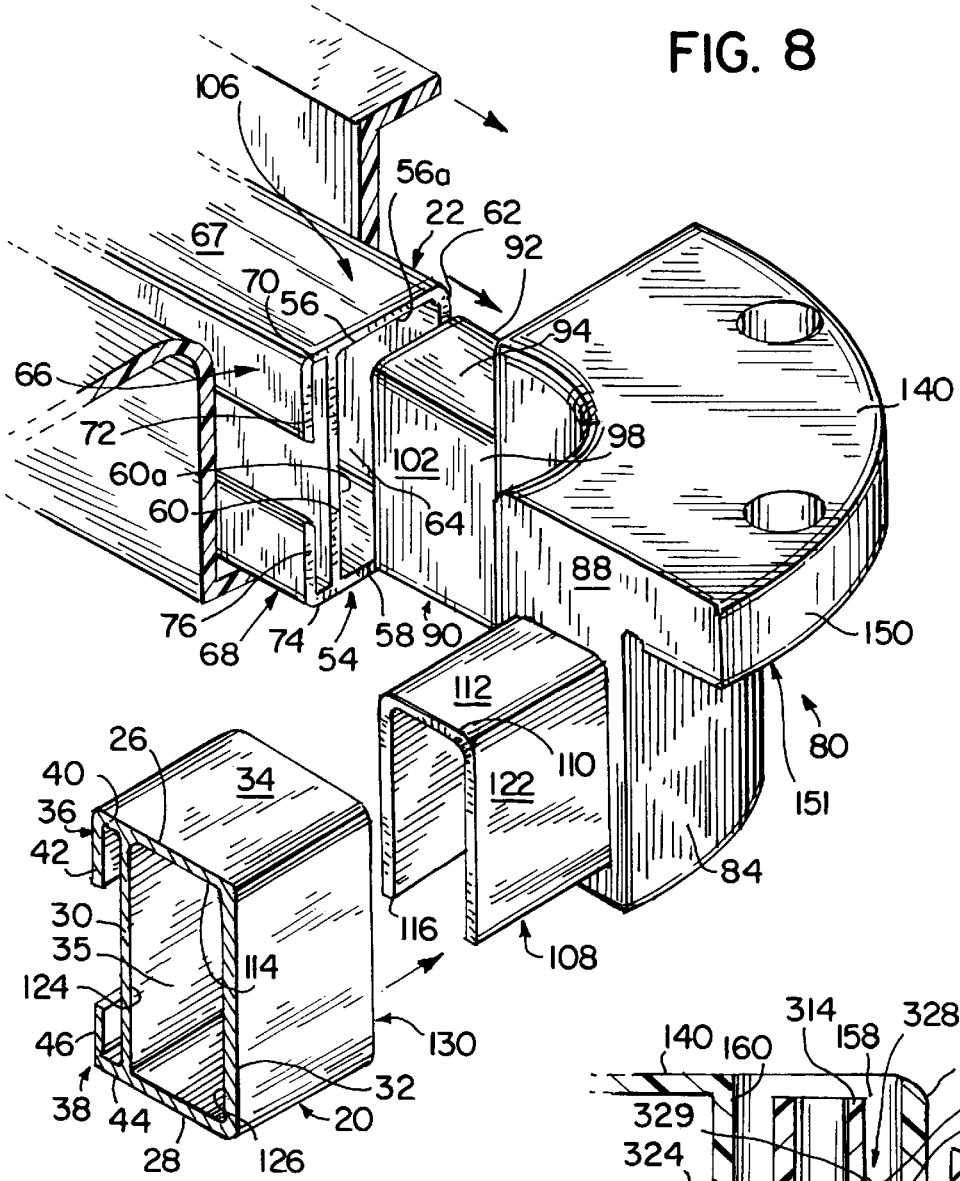
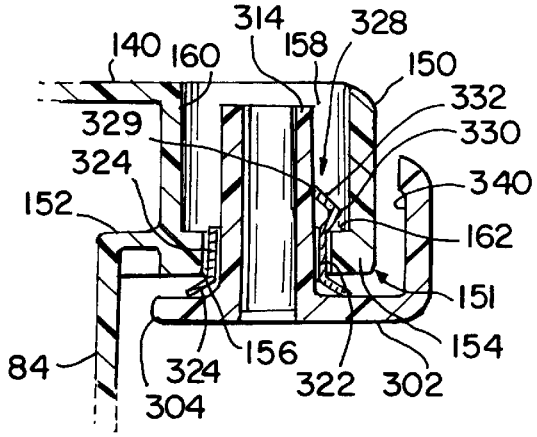
FIG.11

PORTABLE FOLDING TABLE INCORPORATING A LIGHTWEIGHT CORE

BACKGROUND AND SUMMARY OF THE INVENTION

This invention relates to tables, in particular, to a portable, folding table of lightweight construction.

Typically, a folding table includes a table top having an apron mounted to its underside which strengthens and stiffens the table top. One or more folding leg assemblies are interconnected to the underside of the table top in order to support the table top above a supporting surface.

Table tops of prior art tables are often fabricated from rigid materials, such as particle board, plywood, or other composite wood materials. As a result, the weight of tables having table tops constructed and from these types of materials is significant and makes the tables difficult to set up and arrange by a single individual. Consequently, two or more individuals are often required to handle such prior art tables.

Further, in order to increase the strength and stability of prior art table tops, such table tops have been often made thicker. By making the table tops thicker, the weight problem is increased.

In order to rectify the weight problem, attempts have been made to develop a portable, lightweight table. For example, in Cobos et al U.S. Pat. No. 4,951,576, a portable folding table is provided which includes a plastic sandwich framework structure. The structure includes upper and lower plastic table top halves and a framework grid sandwiched therebetween. The table top halves are bonded or cemented to one another. The framework grid is preferably made of wood and includes joists or beam members interconnected by cross members.

In the '576 patent, the framework grid of the table top is preferably made of wood in order for the table top disclosed therein to have sufficient strength and rigidity. Therefore, while the table described in the '576 patent reduces the weight problem associated with prior art tables by eliminating the solid core of the table top, the weight of the table structure described in the '576 patent is still considerable.

In Bonham U.S. Pat. No. 5,271,338, a lightweight table top is disclosed for use with portable and/or collapsible tables. The table top includes a support layer of thin laminated wood and a plastic cover layer bonded to the support layer by pressing the cover layer and the support layer together with an adhesive therebetween. Support beams, preferably of wood, are provided under the support layer, and a bottom protective layer is provided underneath the table top for appearance and durability. Once again, the use of wood beams in constructing the table top renders the table heavier than is desirable.

Therefore, it is a primary object and feature of the present invention to provide a portable table which is lightweight and easy to handle by a single individual.

It is a further object and feature of the present invention to provide a portable table which incorporates a table top of sufficient strength and rigidity.

It is a still further object and feature of the present invention to provide a portable table which is resistant to corner and edge damage.

In accordance with the present invention, a portable, lightweight table includes a table top having a bottom shell and an upper shell engaging the outer periphery of the bottom shell. The bottom and upper shells define a core receiving cavity therein. A core is receivable within the core receiving cavity defined by the bottom and top shells. It is contemplated that the core be constructed from a sheet of double faced corrugated paperboard. A leg structure is interconnected to the table top for supporting the table top above a supporting surface.

The bottom shell includes an apron receiving channel adjacent the outer periphery of the bottom shell. The apron receiving channel includes first and second parallel side portions, and first and second end portions transverse to the side portions of the apron receiving channel. A side apron member is seated in each side channel portion of the apron receiving channel.

The bottom shell includes a generally planar portion which is co-planar with a generally horizontal core supporting surface defined by each side apron member. A portion of the core engages and is supported by the horizontal core supporting surfaces of each side apron member. The core may be affixed to the horizontal core supporting surfaces of each side apron. In addition, the bottom shell includes an edge protection structure so as to prevent lateral movement of the core within the core receiving cavity of the table top.

The table assembly also includes first and second end apron members seated in corresponding end portions of the apron receiving channel. Each end apron member includes a generally horizontal core supporting surface. The core supporting surface of each end apron member is co-planar with the generally planar portion of the bottom shell. A portion of the core overlaps and is supported by the generally horizontal core supporting surface of each end apron member. An adhesive may be used to affix the portion of the core to the generally horizontal core supporting surfaces of the end apron members.

A corner member interconnects an end of one of the side apron members with an end of one of the end apron members. The corner member is partially received within the apron receiving channel in the bottom shell of the table top. The corner member includes a first connection element which extends into the interior of the one end of the side apron members, and a second connection element which extends into the interior of the end of one of the end apron members.

The upper shell of the table top includes a bumper connection flange which overlaps the outer periphery of the bottom shell. A bumper is interconnected to the bumper connection flange of the upper shell of the table top. A first portion of the bumper is positioned between an outer wall of the bottom shell and the bumper connection flange of the upper shell. A second, L-shaped portion of the bumper extends from the first portion so as to define a bumper connection flange receiving cavity therebetween for receiving the bumper connection flange of the upper shell of the table top.

A corner bumper is provided for protecting the portion of the bumper connection flange over the corner member. The corner bumper is mounted to the corner by means of a spring clip or the like.

The table assembly further includes a mounting structure for mounting the leg structure to the table top. The mounting structure includes first and second spaced mounting elements affixed to the apron. The moving structure further includes first and second U-shaped leg support brackets which are mounted to a corresponding mounting element so as to capture a portion of the bottom shell therebetween.

The leg structure of the table assembly includes an upper, generally cylindrical cross-brace having a first end supported by one of the leg support brackets and a second end supported by the other leg support bracket. The leg structure is pivotable between a first operative position and second inoperative position.

A folding brace structure controls movement of the leg structure between the first operative position and the second inoperative position. The folding brace structure includes a lower arm having a first end pivotably mounted to the leg structure and a second, opposite end. A second arm has a first end pivotably mounted to the second end of the lower arm, and a second, opposite end. A brace pad is affixed within the bottom shell, and the second end of the arm of the folding brace structure is pivotably mounted thereto.

In accordance with another aspect of the invention, a table assembly includes a bottom shell having an outer periphery. An upper shell engages the outer periphery of the bottom shell wherein the bottom and top shells define a core receiving cavity therebetween. A core is receivable within the core receiving cavity defined by the bottom and top shells. First and second spaced mounting elements engage the core. Each mounting element includes a corresponding leg support bracket interconnected thereto so as to capture a portion of the bottom shell therebetween. A leg structure is pivotably mounted to the leg brackets for supporting the core above a supporting surface. The leg structure is movable between a first operative position and a second non-operative position.

In accordance with yet another aspect of the invention, a table assembly includes a bottom shell having an outer periphery and including an apron receiving channel adjacent the outer periphery. The apron receiving channel includes first and second frame member receiving portions. An upper shell engages the outer periphery of the bottom shell. The bottom and upper shells define a core receiving cavity therebetween. A core is receivable within the core receiving cavity defined by the bottom and upper shells. First and second frame members are seated in corresponding frame member receiving portions of the apron receiving channel. A corner member interconnects an end of one of the frame members with an end of the other frame member. A leg structure supports the core above a supporting surface.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention.

In the drawings:

FIG. 8 is an enlarged, isometric view, partially in section, showing the interconnecting of first and second apron elements by a corner member;

FIG. 11 is a partial cross-sectional view taken along line 11—11 of FIG. 10;

DETAILED DESCRIPTION OF THE INVENTION

Figure 1:
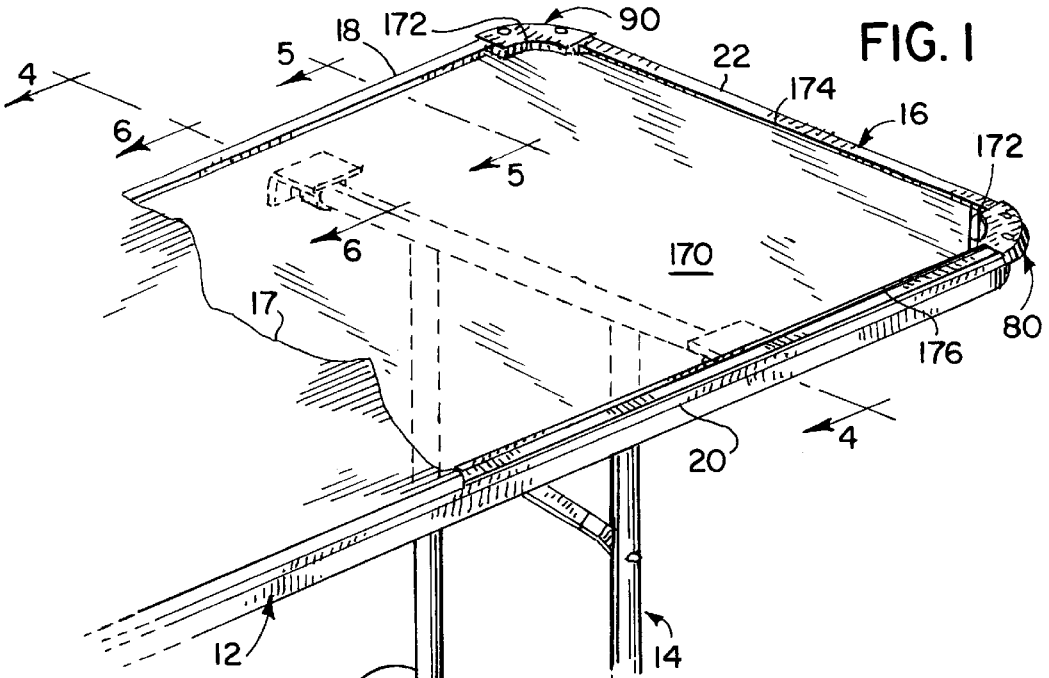
FIG. 1 is an isometric view, with portions broken away, showing a portion of a table in accordance with the present invention.
Figure 2:
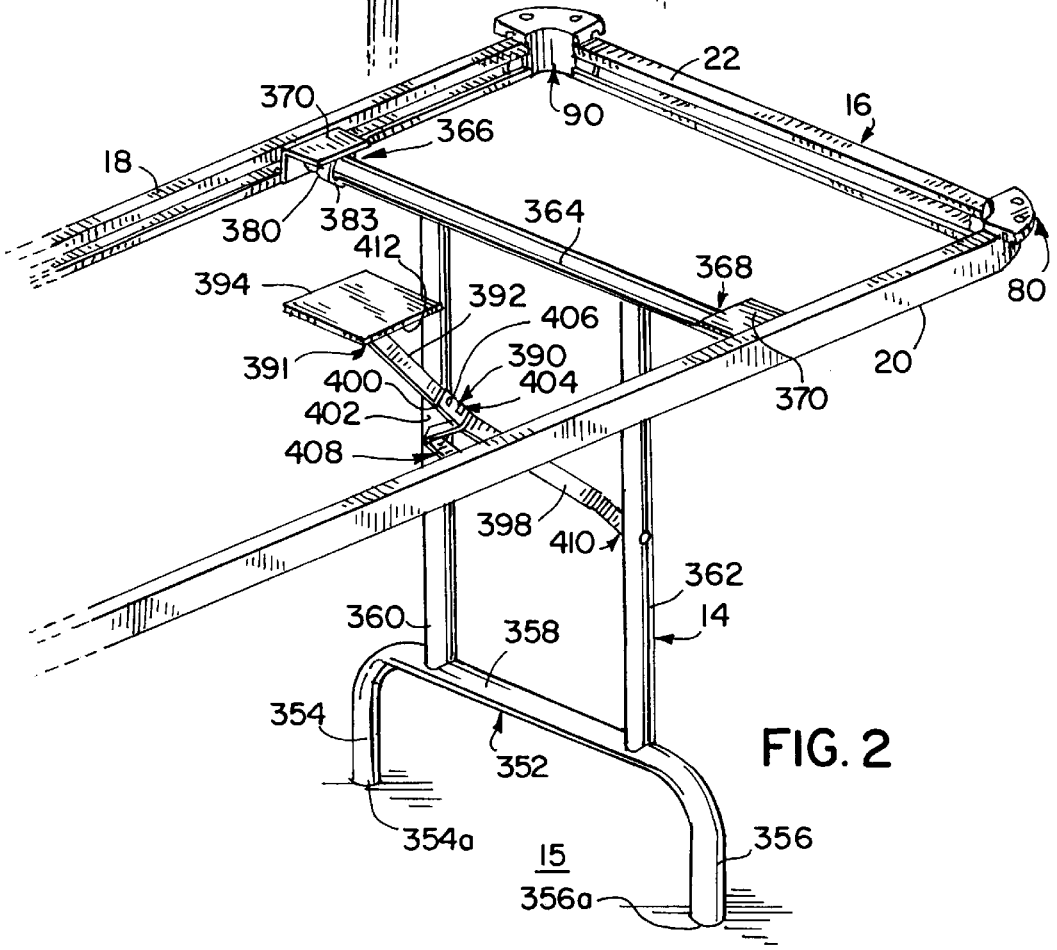
FIG. 2 is an isometric view showing the table of FIG. 1 with portions of the table top of the table removed.

Referring to FIGS. 1 and 2, the table of the present invention is generally designated by the reference numeral 10. Table 10 includes a table top 12 and a pair of folding leg assemblies 14 extending from the bottom surface of the table top 12 in order to support the table top 12 above a supporting surface 15. Table top 12 includes a frame or apron assembly 16 captured between an upper shell 17 and a lower shell 19, FIG. 3. Apron assembly 16 is formed by first and second, parallel, spaced side frame members 18 and 20, respectively, and a pair of parallel, spaced end frame members 22 interconnected thereto. It is contemplated that side frame members 18 and 20, and end frame members 22 may be formed from extruded aluminum in order to reduce the weight of the frame members, while retaining adequate strength characteristics for table top 12.

Figure 4:
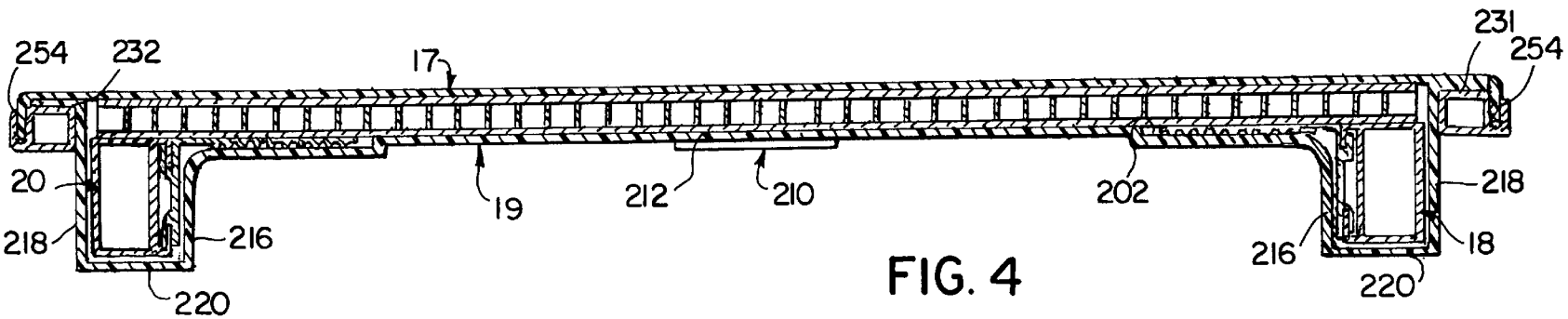
FIG. 4 is a cross-sectional view taken along line 4—4 of FIG. 1.
Figure 5:
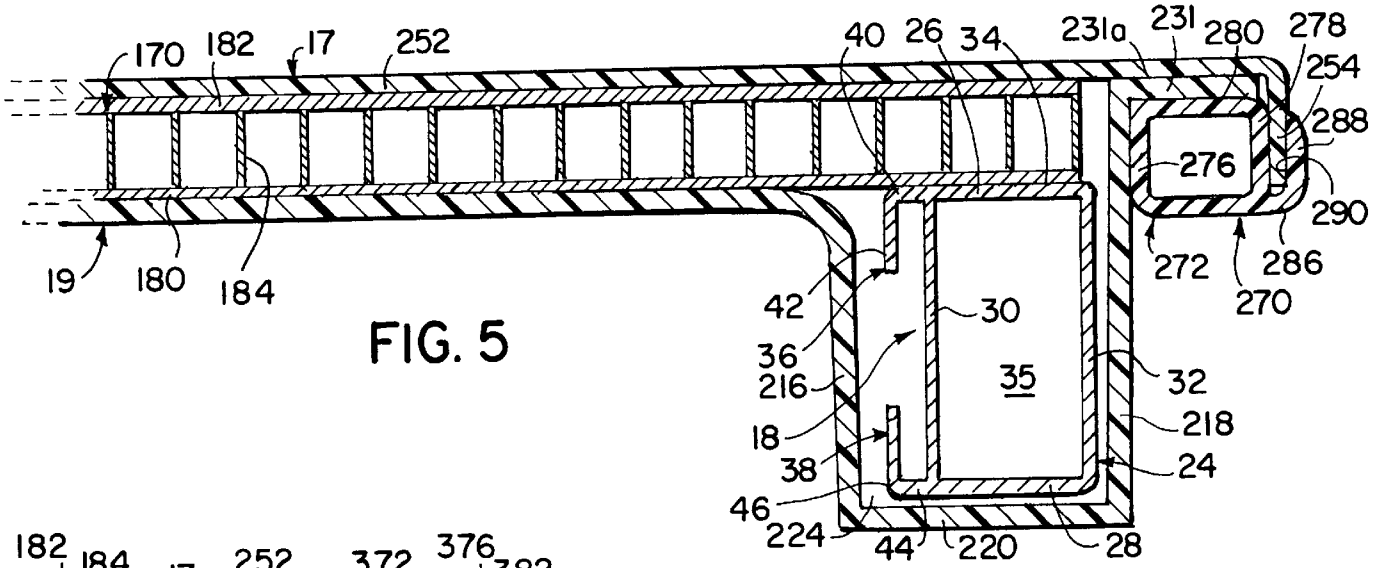
FIG. 5 is a cross-sectional view taken along line 5—5 of FIG. 1.
Figure 6:
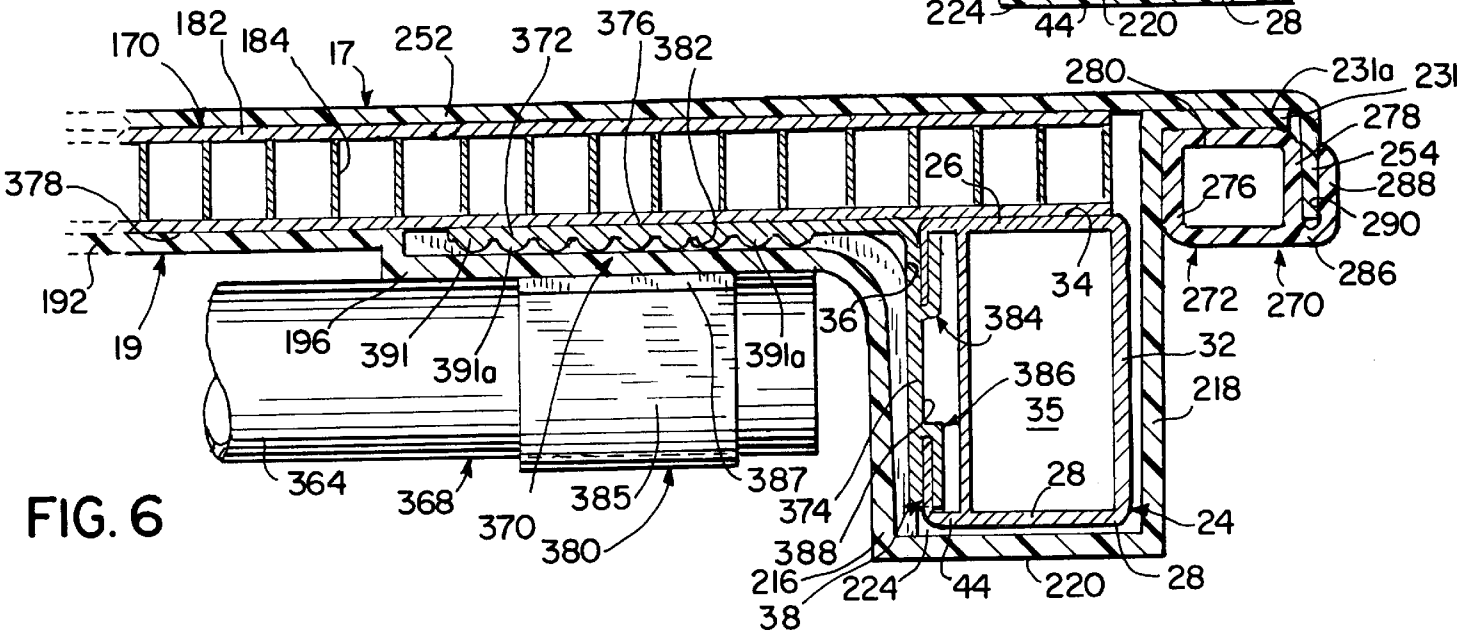
FIG. 6 is a cross-sectional view taken along line 6—6 of FIG. 1.

Side frame members 18 and 20 are identical, and hence, the description of side frame member 18 will be understood to apply to side frame member 20, with common reference characters being used. As best seen in FIGS. 4–6, each side frame member 18 and 20 includes a generally tubular frame element 24 extending along a corresponding longitudinal axis. Each tubular frame element 24 is defined by an upper, horizontal core supporting wall 26 and a spaced, parallel, horizontal lower wall 28. Upper and lower walls 26 and 28, respectively, of tubular frame elements 24 are interconnected by a vertical inner wall 30 and a vertical outer wall 32 which is parallel to and spaced from vertical inner wall 30.

Horizontal walls 26 and 28 and vertical walls 30 and 32 define a cavity 35 within tubular frame elements 24 of side frame members 18 and 20.

Each side frame member 18 and 20 also includes an upper inverted L-shaped flange 36 and a lower L-shaped flange 38 projecting inwardly from inner wall 30 of tubular frame elements 24. Upper L-shaped flange 36 includes an upper, horizontal leg 40 which extends from and is co-planar with upper core supporting wall 26 of tubular frame element 24. A second, vertical leg 42 depends downwardly from the end of horizontal upper leg 40. Similarly, lower L-shaped flange 38 includes a lower, horizontal leg 44 which extends from and is co-planar with lower wall 28 of tubular frame member 24. A second leg 46 of L-shaped flange 38 extends vertically from first leg 44 of L-shaped flange 38 such that vertical leg 46 of L-shaped flange 38 and vertical leg 42 of L-shaped flange 36 lie in a common, vertical plane. Upper L-shaped flange 36, lower L-shaped flange 38, and inner vertical wall 30 of tubular frame element 24 form a generally C-shaped frame structure which opens toward the interior of table 10 to facilitate the mounting of leg assemblies 14 to table top 12, as hereinafter described.

Referring to FIG. 8, end frame members 22 of apron assembly 16 include a generally tubular frame element 54 extending along a corresponding longitudinal axis which is perpendicular to the side frame members 18 and 20. Tubular frame element 54 is defined by a horizontal, upper core supporting wall 56 and a parallel, spaced, horizontal lower wall 58. Upper and lower walls 56 and 58, respectively, are spaced by a first, vertical inner wall 60 and a second, vertical outer wall 62 which is parallel to and spaced from vertical inner wall 60. Horizontal walls 56 and 58 and vertical walls 60 and 62 define a cavity 64 within tubular frame members 54.

Each end frame member 22 includes an upper 66 and a lower 68 L-shaped flange. Upper L-shaped flange 66 includes a horizontal upper leg 70 which extends from and is co-planar with upper core supporting wall 56 of tubular frame elements 54. A vertical leg 72 depends from horizontal upper leg 70. Lower L-shaped flange 68 includes a horizontal lower leg 74 which extends from and is co-planar with horizontal lower wall 58 of tubular frame element 54. A vertical leg 76 extends vertically from the end of horizontal lower wall 74 of lower L-shaped flange 68 such that vertical wall 76 lies in a common vertical plane with vertical wall 72 of upper L-shaped flange 66. Upper L-shaped flange 66, lower L-shaped flange 68, and inner wall 60 of tubular frame elements 54 form a generally C-shaped frame structure opening toward the interior of table 10.

As can be appreciated, end frame members 22 and side frame members 18, 20 have a similar construction, and are preferably formed from a common extrusion in order to reduce manufacturing costs.

In order to form the generally rectangular apron assembly 16, FIG. 2, an end of each of side frame members 18 and 20 is interconnected to a corresponding end of one of end frame members 22 by a corner structure 80. Each of the corner structures used for connecting side frame members 18 and 20 and end frame members 22 are identical, and hence, the description of corner structure 80 will be understood to apply to each corner structure shown in FIGS. 1 and 2, with common reference characters being used. It is contemplated to construct each corner structure 80 from a lightweight, rigid plastic material to reduce weight while retaining adequate strength characteristics of the apron assembly 16. Referring to FIGS. 8–12, each corner structure 80 includes a vertical, arcuate inner wall 82, and a vertical, arcuate outer wall 84 radially spaced from arcuate inner wall 82. Arcuate inner wall 82 and arcuate outer wall 84 extend between a vertical, end frame abutting wall 86 and a vertical, side frame abutting wall 88, and are interconnected by cross-braces 89*a–c* which extend radially from the outer surface 82*a* of arcuate inner wall 82 to the inner surface 84*a* of arcuate outer wall 84. Cross-braces 89*a–c* are equally spaced between end frame abutting wall 86 and side frame abutting wall 88.

A generally inverted U-shaped end frame connection element 90 extends laterally from end frame abutting wall 86 of corner structure 80. End frame connection element 90 includes a horizontal, upper wall 92 having an outer surface 94, and first 98 and second 100 vertical walls depending from opposite sides of horizontal, upper wall 92 and including outer surfaces 102 and 104, respectively.

Figure 9:
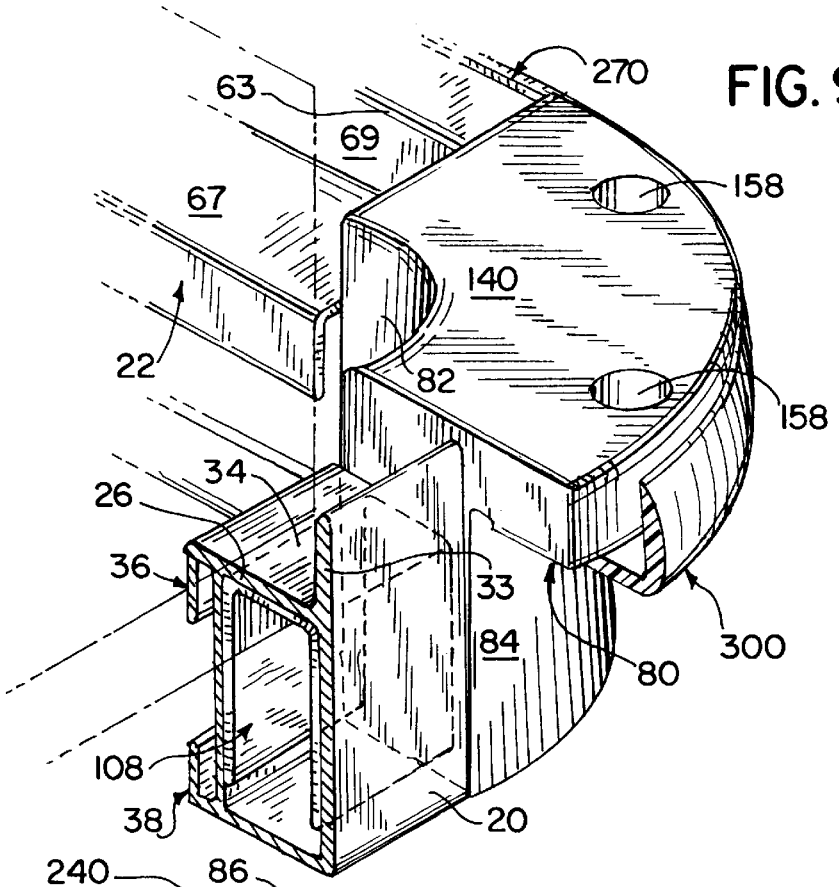
FIG. 9 is an enlarged, isometric view, partially in section, showing first and second apron elements interconnected by the corner member.
Figure 10:
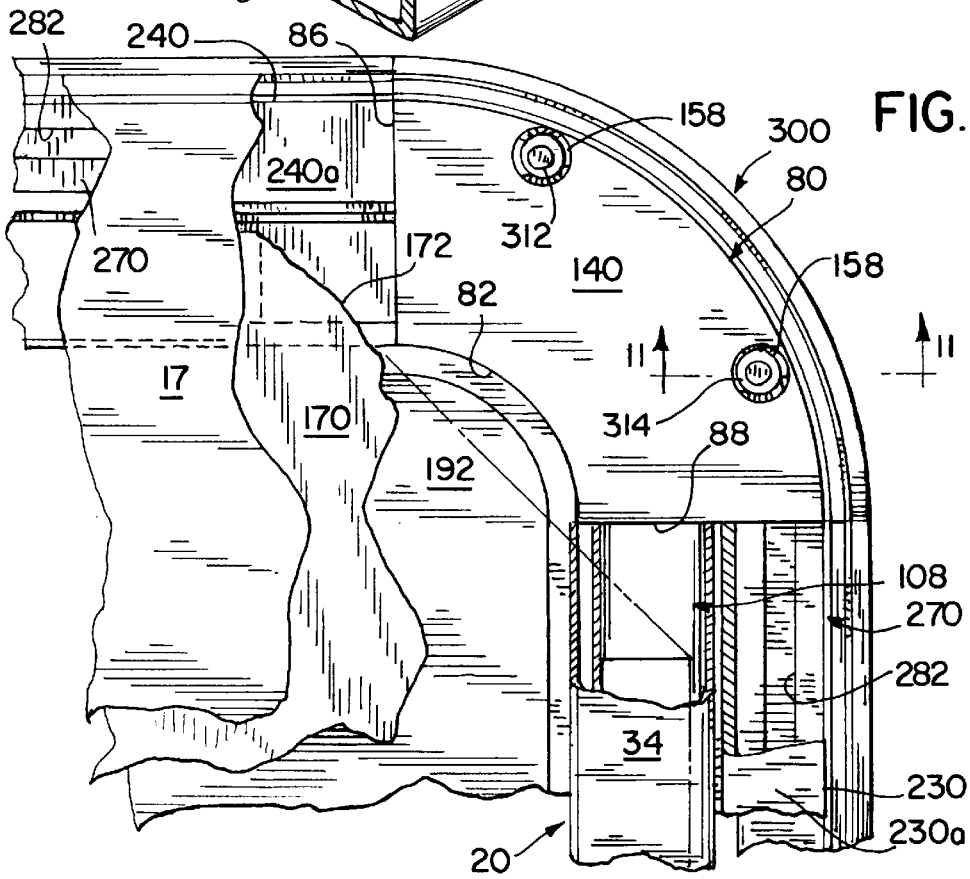
FIG. 10 is a top plan view, with portions broken away, showing a corner of the table top of the table of the present invention.
Figure 12:
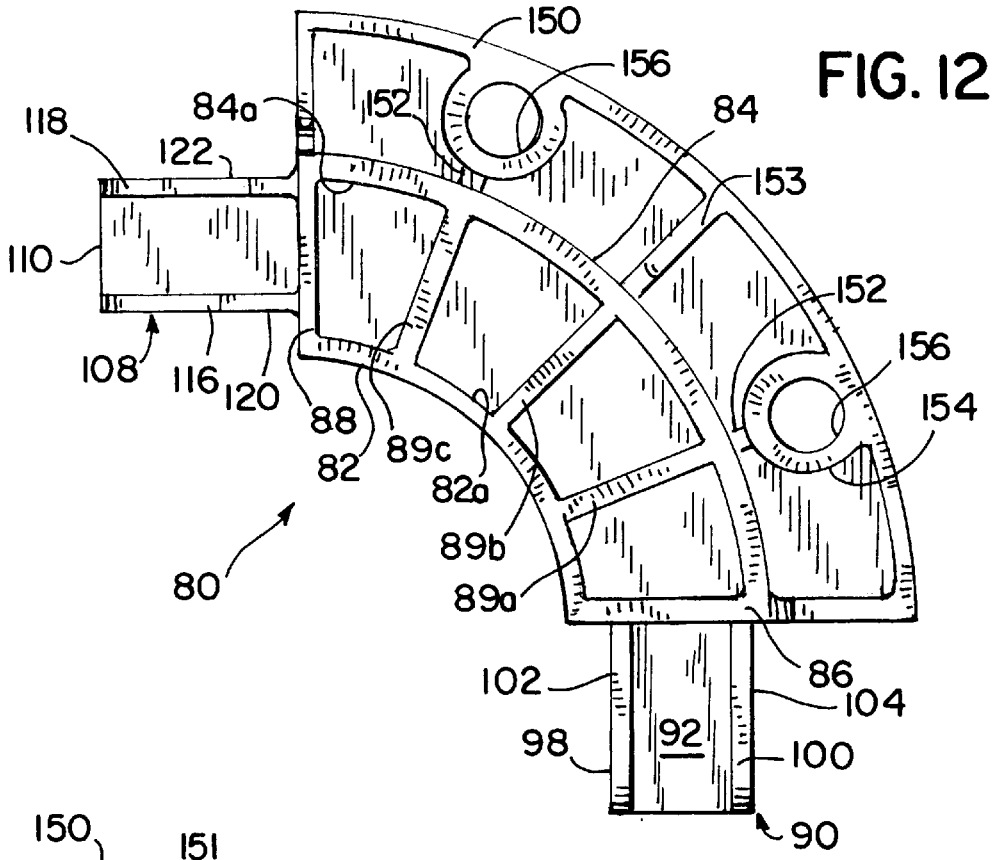
FIG. 12 is a bottom plan view of the corner member of FIGS. 8 and 9.
Figure 13:
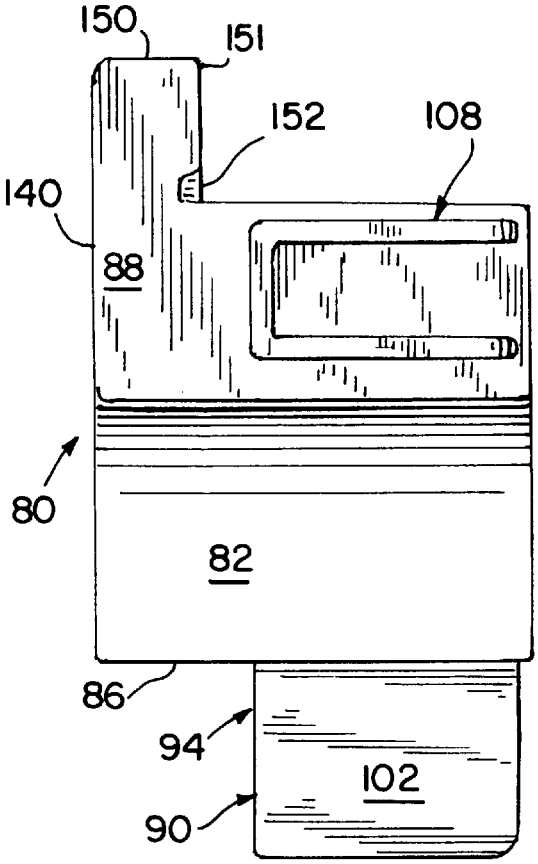
FIG. 13 is a side elevational view of the corner member of FIG. 12.

As best seen in FIGS. 8–10, in order to interconnect end frame member 22 to a corresponding corner structure 80, end frame connection element 90 is inserted into cavity 64 defined by tubular frame element 54 of end frame member 22. Upon insertion of end frame connection element 90 into cavity 64 of end frame member 22, outer surface 94 of horizontal wall 92 forms a slidable interface with corresponding inner surface 56*a* of core supporting wall 56 of end frame member 22, and outer surfaces 102 and 104 form a slidable interface with the inner surfaces 60*a* and 62*a*, respectively, of outer walls 60 and 62, respectively, of end frame member 22.

As end frame connection element 90 of corner member 80 is inserted into cavity 64 defined by generally tubular frame element 54, outer surfaces 94, 102 and 104 of walls 92, 98 and 100, respectively, of end frame connection element 90 form a frictional fit within corresponding inner surfaces 56*a*, 60*a* and 62*a* of walls 56, 60 and 62, respectively, of end frame member 22. Connection element 90 of corner member 80 is inserted into cavity 64 in tubular frame element 54 such that end 106 of end frame member 22 abuts end frame abutting wall 86 of corner structure 80, FIG. 9.

Corner structure 80 further includes a generally inverted U-shaped side frame connection element 108 which extends laterally from side frame abutting wall 88. Side frame connection element 108 includes first and second vertical walls 116 and 118, respectively, which depend from opposite sides of horizontal, upper wall 110. Vertical walls 116 and 118 and upper wall 110 of side frame connection element 108 include corresponding outer surfaces 112, 120 and 122, respectively.

In order to interconnect corner structure 80 to a corresponding side frame element 18 or 20, side frame connection element 108 is inserted into cavity 35 defined by the generally tubular frame element 24 of side frame members 18 and 20. As side frame connection element 108 of corner structure 80 is inserted into cavity 35, outer surfaces 112, 120 and 122 of side frame connection element 108 form a slidable interface with corresponding inner surfaces 114, 124 and 126, respectively, of walls 26, 30, 32, respectively, of tubular frame element 24. With side frame connection element 108 of corner structure 80 fully received within cavity 35 of a corresponding tubular frame element 24, end 130 of corresponding side frame member 18 and 20 abuts vertical side frame abutting wall 88 of the corner structure 80, FIG. 9, and side frame connection element 108 is frictionally retained with cavity 35 of tubular frame element 24. In its assembled condition, side frame members 18 and 20, end frame members 22, and the four corner structures form a generally rectangular apron assembly 16, FIG. 2.

As best seen in FIGS. 8 and 11, each corner structure 80 further includes a horizontal upper wall 140 which extends between end frame abutting wall 86 and side frame abutting wall 88, and radially from arcuate inner wall 82. Upper wall 140 of corner structure 80 extends radially beyond arcuate outer wall 84 and terminates at an arcuate end wall 150 which depends from the radially outer end of upper wall 140. Arcuate end wall 150 extends between end frame abutting wall 86 and side frame abutting wall 88, and terminates at a lower end 151. Lower end 151 of arcuate end wall 150 is interconnected to arcuate outer wall 84 by a series of lower support ribs 152 and 153. Each lower support rib 152 includes a circular, thickened portion 154 having an opening 156 extending therethrough. Each opening 156 communicates with a corresponding upwardly opening cavity 158 defined by a generally cylindrical wall 160 extending downwardly from upper surface 140 of corner structure 80. As best seen in FIG. 11, cavity 158 has a diameter greater than the diameter of opening 156 in thickened portion 154 of rib 152 such that the upper surface 162 of thickened portion 154 of support rib 152 defines a retaining shoulder within cavity 158.

Referring to FIGS. 1, 5 and 6, a generally rectangular core 170 of double faced paperboard 170 is positioned within apron assembly 16. Paperboard core 170 includes a generally planar lower face 180 and a spaced, generally planar upper face 182 having a honeycomb paperboard media 184 therebetween. It is contemplated as being within the scope of the present invention to construct core 170 of any satisfactory lightweight material such as expanded foam, molded pulp, or other type of corrugated or non-corrugated paperboard. Paperboard core 170 enables table top 12 to be light in weight while retaining adequate overall strength properties when assembled.

The outer periphery of paperboard core 170 overlaps and is supported by the upper core supporting walls 26 and 56 of tubular frame members 24 and 54, respectively. As best seen in FIG. 1, each corner 172 of paperboard core 170 is angled such that a length of each end edge 174 of paperboard core 170 is less than the length of each end frame member 22, and such that the length of each side edge 176 of paperboard core 170 is less than the length of each side frame member 18 and 20.

Figure 3:
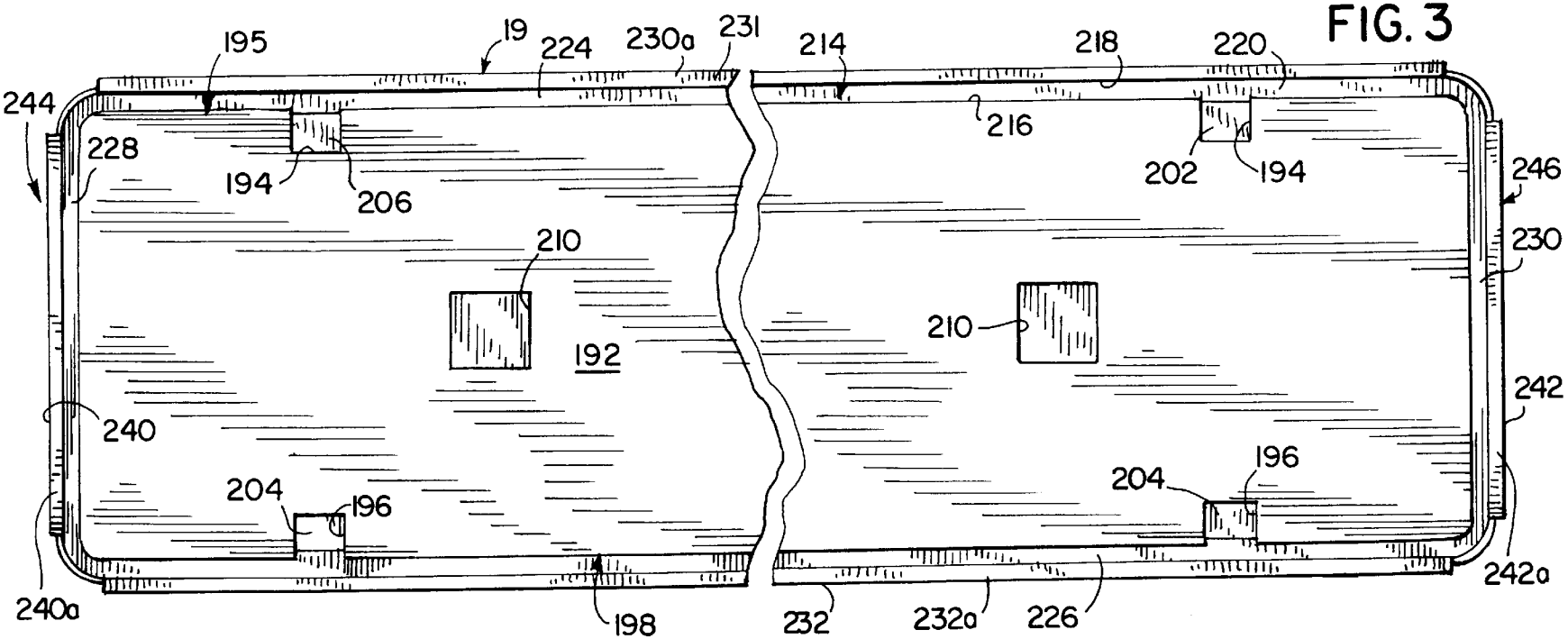
FIG. 3 is a top plan view of the bottom shell of the table top of the table of the present invention.

Apron assembly 16 with paperboard core 170 supported thereon is received within lower shell 19 which is constructed from a rigid, lightweight plastic material which also provides strength to table top 12 when assembled. Referring to FIG. 3, lower shell 19 is generally rectangular in shape and includes a generally planar bottom portion 192 having a first pair of generally rectangular depressions 194 formed therein at a location adjacent a first side edge 195 of bottom portion 192 and a second pair of generally rectangular depressions 196 formed therein at a location adjacent a second side edge 198 of bottom portion 182. Depressions 194 and 196 define corresponding recessed surfaces 202 and 204, respectively, in bottom portion 192 of lower shell 19.

Bottom portion 192 also includes a pair of brace receiving depressions 210 partially defined by an upwardly facing brace engaging surface 212 for engaging a table top supporting brace, as hereinafter described.

Lower shell 19 also includes an apron receiving trough 214 which extends about the entire periphery of the bottom portion 192 of lower shell 19. Apron receiving trough 214 is defined by a first inner wall 216 which depends from the outer edge of bottom portion 192 of lower shell 19, and a spaced, vertical outer wall 218. Inner wall 216 and outer wall 218 are interconnected by a bottom wall 220 which is parallel to and vertically spaced from the bottom portion 192 of lower shell 19.

Apron receiving trough 214 includes parallel, first and second side frame member receiving portions 224 and 226, and parallel, end frame receiving portions 228 and 230 which are perpendicular to side frame member receiving portions 224 and 226. Lower shell 19 further includes first and second side table surface supporting flanges 231 and 232 which project laterally from the upper edge of outer wall 218 on opposite sides 234 and 236 of lower shell 19. Similarly, first and second end table surface supporting flanges 240 and 242 extend laterally from outer wall 218 at opposite ends 244 and 246, respectively, of lower shell 19. Side table surface supporting flanges 231 and 232 and end table surface supporting flanges 240 and 242 engage and support table top surface 17.

In order to assemble table top 12, apron assembly 16 is positioned such that side frame members 18 and 20 are received within corresponding side frame receiving portions 224 and 226, respectively, of trough 214, and such that end frame members 22 are received within corresponding end frame receiving portions 228 and 230 of trough 214.

The depth of trough 214 in lower shell 19 substantially equal to the height of vertical walls 30 and 32 of side frame members 18 and 20 and the height of vertical walls 60 and 62 of end frame members 22 such that core supporting walls 26 of side frame members 18 and 20, and core supporting walls 56 of end frame members 22 are co-planar with the bottom portion 192 of lower shell 19.

The lower face 180 of paperboard core 170 may be affixed by means of an adhesive such as glue, cement or the like to the generally planar bottom portion 192 of lower shell 19 and to horizontal core supporting walls 26 of side frame members 18 and 20 and to horizontal core supporting walls 56 of end frame members 22.

Table top 12 further includes a table top surface 17 constructed from a rigid, scuff resistant material, such as a plastic material in order that table top 12 retain sufficient strength characteristics when assembled. Table top surface 17 includes a generally rectangular planar portion 252 having a bumper connection flange 254 depending from the outer periphery thereof. Bumper connection flange 254 includes an outer surface 255 having a V-shaped groove 257 therein to facilitate the connection of bumper elements 270 thereto, as hereinafter described.

Figure 7:
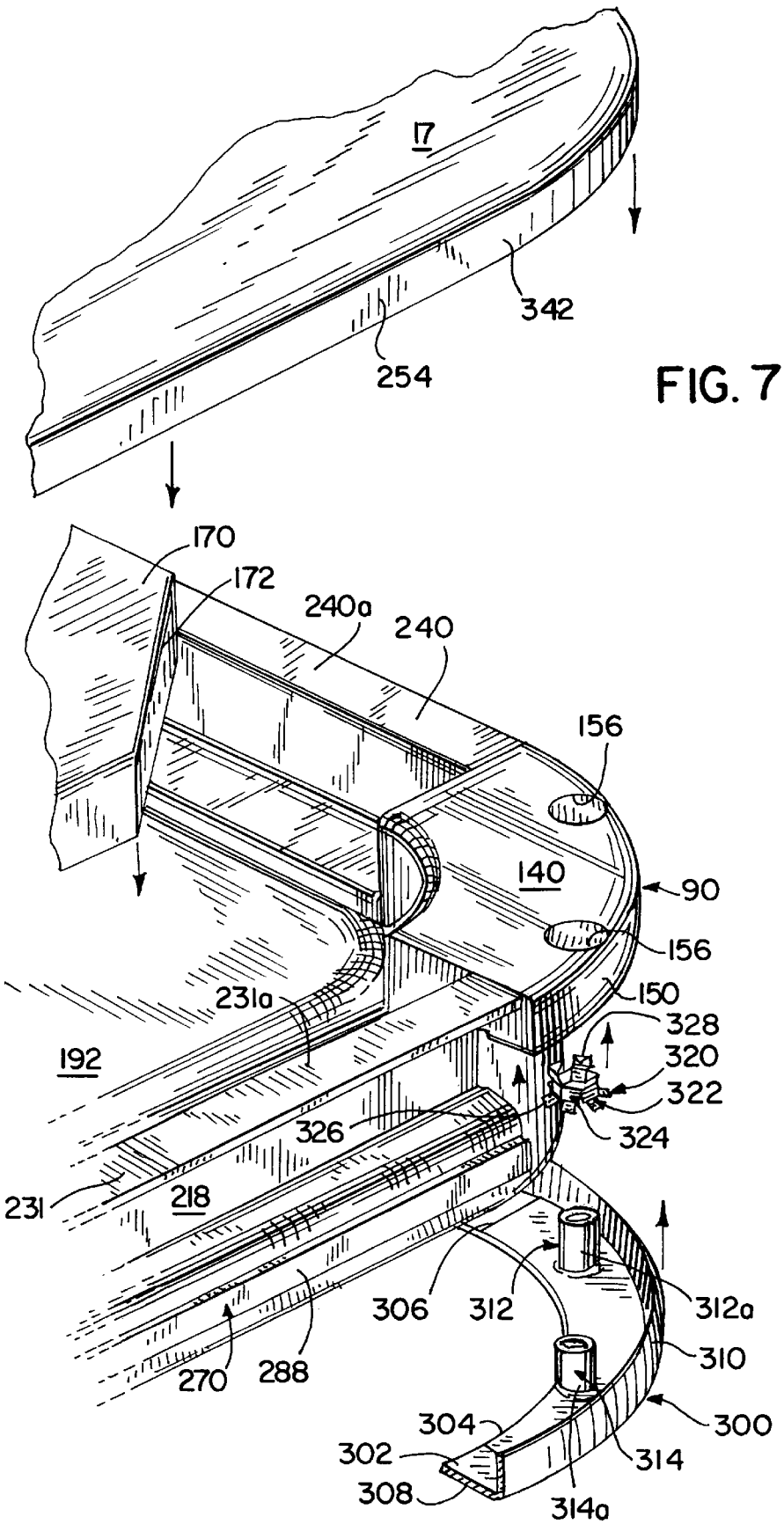
FIG. 7 is an exploded, isometric view showing a corner of the table top of the table of the present invention.

Table top surface 17 is positioned on the corrugated paperboard core 170 and lower outer shell 19 such that the bottom surface 256 of the generally planar portion 252 of table top surface 17 engages and is supported by the upper layer 182 of corrugated paperboard core 170 and by flanges 231, 232, 240 and 242 which extend from the outer periphery of lower outer shell 19. An adhesive may be placed between the downwardly facing surface 256 of the planar portion 252 of table top surface 17 and the upper layer 182 of corrugated paperboard core 170, as well as between the downwardly facing surface 256 and the upper surfaces 231*a*, 232*a*, 240*a* and 242*a* of flanges 231, 232, 240 and 242, respectively, extending from the outer periphery of lower shell 19, in order to affix table top surface 17 to corrugated paperboard core 170 and lower shell 19. As best seen in FIG. 7, with the table top surface 17 fixed in position, bumper connection flange 254 overlaps the outer edges of table surface connection flanges 231, 232, 240 and 242 of lower shell 19, and the arcuate end walls 150 of corner structures 80.

Four bumper elements 270 are mounted to the bumper connection flange 254 of table top surface 17 to protect the outer periphery of table top 12. As shown in FIGS. 5 and 6, each bumper element 270 includes a generally tubular portion 272 which is defined by a bottom wall 274 having first 276 and second 278 spaced sidewalls projecting vertically therefrom. An upper wall 280 is positioned between sidewalls 276 and 278 of bumper element 270. It is contemplated that bumper element 270 may be an extruded member formed from a resilient material such as rubber or the like so as to allow for the limited movement of sidewalls 276 and 278.

Each bumper element 270 further includes a generally L-shaped edge protection portion 284 having a first leg 286 which projects laterally from sidewall 278 of tubular portion 272 and is generally co-planar with bottom wall 274. A second leg 288 extends generally vertically from first leg 286 and is biased towards sidewall 278 by the resiliency of the material from which bumper element 270 is constructed. Sidewall 278 and second leg 288 of bumper element 270 define a bumper connection flange receipt cavity 290 therebetween.

Each bumper element 270 is positioned below a corresponding table surface connection flange 231, 232, 240 and 242 such that sidewall 276 of bumper element 270 engages outer wall 218 of lower shell 19 and such that upper wall 280 of bumper element 270 abuts the downwardly facing surface of corresponding flanges 231, 232, 240 and 242 of lower shell 19.

In order to interconnect bumper elements 270 to bumper connection flange 254, a portion of bumper connection flange 254 is inserted within a corresponding bumper connection flange receipt cavity 290 of each bumper element 270. Second leg 288 of each bumper element 270 prevents damage to the outer surface 255 of bumper connection flange 254 and adds to the aesthetic appearance of table top 12. It is contemplated that the resiliency of the material from which bumper element 270 is formed allows for the limited movement of bumper connection flange 254 with respect to the planar portion 252 of table top surface 17 thereby reducing the likelihood of damage to the bumper connection flange during handling or use of table 10. It is further contemplated that the resiliency of the material from which bumper elements 270 are formed causes second sidewall 278 of bumper element 270 to urge bumper connection flange 254 toward a vertical position.

Referring to FIGS. 7 and 9–11, table top 12 further includes four corner protection elements 300 for protecting each corner structure 80 and for protecting the portions of bumper connection flange 254 which overlap corner structures 90. Each corner protection element 300 includes a generally flat base portion 302 having an arcuate inner edge 304 and terminates at first 306 and second 308 ends which are generally perpendicular to each other. An arcuate corner protecting wall 310 extends vertically from the outer arcuate side of base portion 302 such that the cross section of corner protection element 300 taken through the vertical wall 310 and base portion 302 is generally L-shaped.

Each corner protection element 300 further includes first and second cylindrical alignment members 312 and 314, respectively, extending vertically from the upper surface 316 of base 302 of corner protection elements 300. Cylindrical alignment members 312 and 314 define outer cylindrical surfaces 312*a* and 314*b*, respectively, and have a diameter less than the diameter of each opening 156 in support rib 152 of each corner structure 80.

In order to interconnect each corner protection element 300 to a corresponding corner structure 80, a connector such as spring clip 320 is used. Each spring clip 320 includes a generally cylindrical center ring portion 322 having a diameter generally equal to the diameter of cylindrical alignment members 312 and 314 of corner protection element 300. Ring portion 322 is polygonal in shape and includes a plurality of generally flat sides 324. A spacer element 326 depends from each side 324 of ring portion 322 of connector 320. Each connector 320 further includes a plurality of generally V-shaped retaining elements 328 which are circumferentially spaced about and extend upwardly from ring portion 320. Each retaining element 328 includes a lower leg 330 which extends radially outwardly from the upper edge of ring portion 322 of connector 320, and a second leg 332 which extends upwardly from the second opposite end of leg 330 of retaining element 328 and terminates at a sharpened tip 329.

In order to connect corner protection elements 300 to corresponding corner structures 80, a spring clip 320 is partially inserted into each opening 156 in each corner structure 80 such that the thickened portion 154 of lower support rib 152 of corner structure 80 is captured between spacer elements 326 and lower legs 330 of retaining element 328 of connector 320, as shown in FIG. 11. Cylindrical alignment members 312 and 314 are inserted into corresponding ring portions 322 of connectors 320 such that the sharpened tip 329 of each retaining element 328 embeds in the outer cylindrical surfaces 312*a* and 314*a* of corresponding cylindrical alignment members 312 and 314, respectively, so as to prevent vertical movement of tubular alignment members 312 and 314. In addition, since the diameter of each cylindrical alignment member 312 and 314 is generally equal to the diameter of ring portion 322 of each connector 320, cylindrical alignment members 312 and 314 are frictionally retained by ring portion 322 of connector 320 partially within cavity 158 in corner structure 80.

As best seen in FIG. 11, arcuate end wall 150 of corner structure 80 and corner protecting wall 310 of corner protection element 300 define a bumper connection flange receipt cavity 340 therebetween. As table top surface 17 is positioned on paperboard core 170, the portion 342, FIG. 7, which overlaps the arcuate end wall 150 of corner structure 80 is partially received within corresponding bumper connection flange receipt cavity 340. Corner protecting wall 310 of each corner protection element 300 protects the corresponding portion 342 of table top surface 17 and enhances the aesthetic appearance of table top 12.

As best seen in FIGS. 2 and 6, table top 12 further includes four leg assembly support brackets 370. Two of the leg support brackets 370 are interconnected to side frame member 18 and two of the leg assembly support brackets 370 are interconnected to side frame member 20 in order to support folding leg assemblies 14.

Each leg assembly support bracket 370 is generally L-shaped and includes a horizontal first leg 372 and a vertical second leg 374 perpendicular thereto. Each leg assembly support bracket 370 interconnected to side frame member 18 is aligned with a distinct, corresponding rectangular depression 194 formed in the bottom portion 192 of lower shell 19 such that horizontal first leg 372 overlaps opening 206 in bottom portion 192 of lower shell 19, and each leg assembly support bracket 370 interconnected to side frame member 20 is aligned with a distinct, corresponding depression 196 in the bottom portion 192 of lower shell 19.

First leg 372 of each leg assembly support bracket 370 includes a first upper surface 376 engaging the underside 378 of the lower face 180 of paperboard core 170 and opposite, second downwardly facing surface 382. Downwardly facing surface 382 of first leg 372 of each leg assembly support bracket 370 includes a plurality of ribs 381 extending thereacross. The apex 381*a* of each rib 381 engages a corresponding depression 196 in the bottom portion 192 of lower shell 19. Ribs 391 increase the strength of first leg 372 of each leg assembly support bracket 370.

Four leg supporting brackets 380 are positioned outside of lower shell 19 and aligned with a corresponding one of depressions 194 and 196 in the bottom portion 192 of lower shell 19. Each leg supporting bracket includes a U-shaped leg receiving portion 385 which defines a generally U-shaped opening 383 for pivotably supporting folding leg assemblies 14, and a connection flange 387 extending from the upper end thereof. Connection flange 387 of each leg supporting bracket 380 is interconnected to a corresponding first leg 372 of each leg assembly support bracket 370 so as to capture corresponding depression 194 and 196 in the bottom portion 192 of lower shell 19 therebetween.

Leg assembly support bracket 370 further includes upper 384 and lower 386 L-shaped connection flanges which extend from outer surface 388 of second leg 374. Connection flanges 384 and 386 are adapted to form a mating relationship with corresponding upper and lower L-shaped flanges 36 and 38, respectively, of side frame members 18 and 20 to further secure leg assembly support brackets 370 to the structure of table top 12. Connection flanges 384 and 386 engage flanges 36 and 38, respectively, in such a manner as to enable bracket 370 to be slid longitudinally along frame member 24 to its desired position in alignment with depression 194.

Referring to FIGS. 1 and 2, table top 12 is supported above supporting surface 15 by folding leg assemblies 14. Each folding leg assembly 14 is mounted to table top 12 for movement between an extended, operative position, as shown in FIGS. 1 and 2, and a folded, inoperative position, as is conventional.

Each folding leg assembly 14 includes an inverted, generally U-shaped base 352 having first 354 and second 356 spaced vertical legs which are interconnected by a generally horizontal lower cross-brace 358. Vertical legs 354 and 356 of each U-shaped base 352 include lower, generally flat supporting surface engaging surfaces 354*a* and 356*a*, respectively, for engaging supporting surface 15.

First and second vertical supports 360 and 362 extend between cross-brace 358 of U-shaped base 352 and a pivotable, upper cross brace 364. Upper cross brace 364 is generally cylindrical in shape and includes first and second opposite ends 366 and 368. End 366 of cross-brace 364 is received within U-shaped opening 386 defined by U-shaped leg supporting bracket 380 aligned with depression 194 in lower shell 19, and end 368 of cross-brace 364 is received within U-shaped opening 386 defined by U-shaped leg supporting bracket 380 aligned with depression 196 in lower shell 19 so as to allow upper cross-brace 364 to pivot within U-shaped leg support brackets 380.

A folding brace assembly 390 is interconnected to each folding leg assembly 14 in order to allow leg assemblies 14 to be pivoted between an extended, operative position, as shown in FIGS. 1 and 2, and a folded, inoperative position with leg assemblies folded flat against lower shell 19. Each folding brace 390 is preferably provided with an inverted Y-shape including an upper arm 392 having an upper end 391 pivotably mounted to the underside 393 of a brace pad 394 which is seated within brace receiving depression 210 thereby capturing a portion of lower shell 19 therebetween. Lower end 400 of upper arm 392 extends between two lower arms 396 and 398 of folding brace 390. The lower end 400 of upper arm 392 is pivotably mounted between the upper ends 402 and 404 of lower arms 396 and 398, respectively, by a hinge device 406. Hinge device 406 may include a conventional locking pawl which limits lower arms 396 and 398 to clockwise rotation with respect to upper arm 392 so as to prevent the pivoting of leg assembly 14 outwardly from its extended, operative position.

Lower ends 408 and 410 of lower arms 396 and 398, respectively, are pivotably mounted to vertical legs 354 and 356, respectively, of leg assemblies 14 in a conventional manner. Brace pad 394 is seated within corresponding brace receiving depression 210, FIG. 3, such that the lower surface 412 of brace pad 394 is affixed to brace engaging surface 212 of lower shell 19. It is contemplated to affix the lower surface 412 of base pad 394 to brace engaging surface 212 of lower shell 19 by means of an adhesive or the like.

It can be seen from the above-description that the table 10 of the present invention incorporating a paperboard core 170 into table top 12 greatly reduces the overall weight of table top 12, and hence, the overall weight of table 10. Further, by the use of aluminum extruded frame members and plastic components, the table top 12 is of sufficient strength when assembled while maintaining a relatively low cost of manufacture and assembly.

Various alternatives and embodiments are contemplated as being within the scope of the following claims particularly pointing out and distinctly claiming the subject matter regarded as the invention.

We claim:

1. A table assembly, comprising:

a table top including a bottom shell and an upper shell engaging an outer periphery defined by the bottom shell, the bottom and top shells defining a core receiving cavity therebetween, wherein the bottom shell includes an apron receiving channel adjacent the outer periphery of the bottom shell, the apron receiving channel including first and second parallel side portions, and first and second end portions transverse to the side portions of the apron receiving channel, wherein the bottom shell includes a generally planar portion and wherein the apron receiving channel projects downwardly from the generally planar portion of the bottom shell;

a core receivable with the core receiving cavity defined by the bottom and top shells;

first and second side apron members, each side apron member seated in a corresponding side channel portion of the apron receiving channel;

first and second end apron members, each end apron member seated in a corresponding end portion of the apron receiving channel;

a corner member for interconnecting an end of one of the side apron members with an end of one of the end apron members, wherein the upper shell includes a bumper connection flange which overlaps the corner member;

a corner bumper for protecting the portion of the bumper connection flange over the corner member;

wherein the corner member includes a passageway therein, the passageway including a first portion having a first diameter and a second portion having a second diameter, less than the first diameter, so as to define a shoulder within the corner member; and a leg structure interconnected to the table top for supporting the table top above a supporting surface.

2. The table assembly of claim 1 further comprising a connection structure for interconnecting the corner bumper to the corner member.

3. The table assembly of claim 2 wherein the corner bumper includes a cylindrical alignment element having a predetermined diameter and extending into the passageway in the corner member.

4. The table assembly of claim 3 wherein the connection structure includes a ring portion having an inner diameter generally equal to the diameter of the cylindrical alignment element of the corner bumper and positioned about the cylindrical alignment element of the corner bumper, the connection structure including a first V-shaped retaining member having a first leg extending radially from the ring portion into the first portion of the passageway in the corner member, and a second leg.

5. The table assembly of claim 4 wherein the second leg of the V-shaped connection element includes a sharpened tip engaging the cylindrical alignment member so as to retain the cylindrical alignment member partially within the passageway in the corner member.

6. A table assembly, comprising:

a table top including shell structure defining an internal cavity and a core disposed within the internal cavity;

one or more structural apron members engaged with the shell structure;

one or more leg support members interconnected with at least one of the structural apron members by means of mating engagement structure including groove structure associated with one of the leg support member and the structural apron member, and engagement structure associated with the other of the leg support member and the structural apron member and engageable within the groove structure; and a leg arrangement interconnected with the table top and including a connection in the vicinity of each leg support member.

7. The table assembly of claim 6, wherein the groove structure is associated with the structural apron member and extends throughout the length of the structural apron member.

8. The table assembly of claim 7, wherein the groove structure is defined by a pair of flanges which extend toward each other and which define ends spaced apart from each other so as to form an entrance to the groove structure, and wherein the engagement structure is provided on the leg support member and includes a pair of slots for receiving the flanges and for providing sliding movement of the leg support member relative to the structural apron member.

9. The table assembly of claim 7, wherein the structural apron member comprises an extrusion member including a series of walls defining a closed geometric shape for providing structural rigidity to the structural apron member, and wherein the groove structure is located exteriorly of the closed geometric shape and faces inwardly relative to the table top.

10. A table assembly, comprising:

a table top including shell structure defining an internal cavity and a core disposed within the internal cavity;

one or more structural apron members engaged with the shell structure;

one or more leg support members interconnected with at least one of the structural apron members, wherein each leg support member includes a first portion engaged with one of the structural apron members and a second portion extending laterally relative to the first portion and underlying the core; and a leg arrangement interconnected with the table top and including a leg supporting bracket interconnected with the second portion of the leg support member without connection to the first portion of the leg support member for supporting the leg relative to the table top for movement between a folded position and an extended, operative position.

11. The table assembly of claim 10 wherein the leg arrangement includes an upper, generally cylindrical cross-brace having a first end and a second end supported by a pair of spaced leg support brackets, each of which is interconnected with one of the leg support members, wherein the leg arrangement is pivotable between a first operative position and a second inoperative position.

12. The table assembly of claim 11 further comprising a folding brace structure for controlling movement of the leg arrangement between the first, operative position and the second, inoperative position, the folding brace structure including:

a lower arm having a first end pivotably mounted to the leg arrangement and a second end;

an upper arm having a first end pivotably mounted to the second end of the lower arm, and a second end; and a brace pad affixed to the shell structure, the second end of the upper arm of the folding brace structure pivotably mounted thereto.

13. The table assembly of claim 10, including first and second leg support members for mounting the leg arrangement to the table top, each leg support member including a first horizontal portion engaging the core, and a second vertical portion, each vertical portion of each leg mounting member being interconnected to a structural apron member, and a leg support arrangement with which the leg arrangement is engaged.

14. The table assembly of claim 10, wherein the leg support member is interconnected with the structural apron member by means of mating engagement structure including groove structure associated with the structural apron member and engagement structure associated with the leg support member.

15. The table assembly of claim 10, wherein the shell structure includes a bottom shell member including a depression within which the second portion of the leg mounting member is received, wherein the depression defines a wall sandwiched between the leg supporting bracket and the second portion of the leg support member.

16. A table assembly, comprising:

a table top including shell structure defining an internal cavity and a core disposed within the internal cavity;

one or more structural apron members engaged with the shell structure, wherein the one or more structural apron members include a pair of apron members which are located at an angle relative to each other and define ends which are spaced from each other;

a corner member engaged with the ends of the pair of apron members;

a pair of bumper arrangements, each of which is interconnected with the shell structure exteriorly of one of the pair of apron members, wherein the bumper arrangements are oriented at an angle relative to each other and define a pair of spaced ends; and a corner protector engageable with the corner member separately from the bumper arrangements, wherein the corner protector defines a pair of spaced ends, each of which is located in close proximity to one of the spaced ends defined by the pair of bumper arrangements.

17. The table assembly of claim 16, wherein each bumper arrangement includes an outer flange engaged with and overlying a depending flange defined by the shell structure, and wherein the corner protector includes an outer flange which extends between the ends of the outer flanges defined by the bumper arrangements.

18. The table assembly of claim 17, wherein the corner member includes a pair of upwardly extending openings, and wherein the corner protector includes a transverse wall from which the outer flange extends, wherein a pair of mounting members are provided on the transverse wall and are engageable within the openings for mounting the corner protector to the corner member.

19. The table assembly of claim 18, wherein a locking member is receivable within each opening and engages one of the mounting members for locking the corner protector to the corner member upon application of a push-on force.

* * * * *